US006412601B1

(12) United States Patent
Schmidt

(10) Patent No.: US 6,412,601 B1
(45) **Date of Patent: *Jul. 2, 2002**

(54) LADDER PAN

(76) Inventor: Paul G. Schmidt, 2719 Arrowhead Dr., Langhorne, PA (US) 19053

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/521,077

(22) Filed: Mar. 7, 2000

(51) Int. Cl.[7] ..... E04G 1/00

(52) U.S. Cl. ..... 182/129; 182/120; 182/122; 248/210; 248/238

(58) Field of Search ..... 182/120, 121, 182/122, 129, 33; 248/210, 238; 220/480

(56) References Cited

U.S. PATENT DOCUMENTS

| | | | | | |
|---|---|---|---|---|---|
| 768,364 | A | | 8/1904 | Hines | |
| 3,625,388 | A | * | 12/1971 | Golden | 220/1 |
| D256,730 | S | | 9/1980 | Hester | D25/68 |
| 4,476,984 | A | | 10/1984 | Garrett | 211/86 |
| 4,480,810 | A | | 11/1984 | Hall | 248/238 |
| 4,589,521 | A | * | 5/1986 | Finster et al. | 182/129 |
| 4,874,149 | A | * | 10/1989 | Ory et al. | 248/210 |
| 4,949,925 | A | * | 8/1990 | Gorecki | 248/238 |
| 5,052,581 | A | * | 10/1991 | Christ et al. | 220/570 |
| 5,058,707 | A | * | 10/1991 | Waid | 182/120 |
| 5,421,428 | A | * | 6/1995 | Ingles | 182/106 |
| 5,505,302 | A | * | 4/1996 | Ferley | 182/129 X |
| 5,511,753 | A | * | 4/1996 | Lage | 248/238 |
| 5,544,718 | A | * | 8/1996 | Schumacher | 182/129 |
| 5,547,080 | A | | 8/1996 | Klimas | 206/373 |
| 5,582,269 | A | * | 12/1996 | Gugel et al. | 182/129 |
| 5,613,574 | A | * | 3/1997 | Melanson | 182/129 |
| 5,622,278 | A | | 4/1997 | Fries et al. | 220/480 |
| 5,636,817 | A | * | 6/1997 | Beachy | 248/210 |
| 5,727,649 | A | * | 3/1998 | Buckley | 182/129 |
| 5,782,314 | A | * | 7/1998 | Zeitler | 182/129 |
| 5,803,422 | A | | 9/1998 | Buehler | 248/339 |
| 5,836,557 | A | * | 11/1998 | Bailey et al. | 248/210 |
| 5,873,433 | A | | 2/1999 | Katz | 182/129 |
| 5,899,296 | A | * | 5/1999 | Lantz | 182/214 |
| 6,131,699 | A | * | 10/2000 | Leak, Jr. | 182/129 |

* cited by examiner

*Primary Examiner*—Bruce A. Lev
(74) *Attorney, Agent, or Firm*—Volpe and Koenig, P.C.

(57) ABSTRACT

A suspendible container for holding items that is capable of being attached to holes on a horizontal surface. The container is particularly adaptable to being attached to the top cap of a ladder. The container includes at least one prong which attaches to the container and is removably insertable into a hole in the horizontal surface. The container is particularly suited for holding items such as tools and paint cans that would be needed by the user of a ladder.

11 Claims, 5 Drawing Sheets

LADDER PAN

FIELD OF THE INVENTION

Suspendible device for holding items, particularly for suspension on a ladder.

BACKGROUND OF THE INVENTION

Suspendible containers are often helpful to users of ladders, scaffolding, ledges and the like. These users often require the containers to hold their tools and other work items. Examples of such tools and items include paintbrushes, cans of paint, and tools used by window washers and builders. The number of possible uses for ladders and elevating apparatus, and the tools required for such uses, is unlimited. The prior art teaches a number of suspendible containers that can be elevated from building surfaces such as ladders, scaffolding and ledges. However, the prior art primarily is limited to containers that clamp to the edges of the top caps or rungs of a ladder or other elevating building surfaces. One such device is described in U.S. Pat. No. 4,480,810 (the "'810 patent") entitled "Tool and Parts Tray." The '810 patent discloses a suspendible ladder pan that is attachable to the top cap or rungs of a ladder through the use of an adjustable clamping member.

Many ladders today are manufactured with holes in their top caps. However, none of the prior art teaches a removable suspendible device that can be suspended exclusively from these holes on the top caps of ladders.

SUMMARY OF INVENTION

The present invention relates to a suspendible container for holding items, such as tools and paint cans, that is capable of being attached to a horizontal surface containing holes. At least one prong is attached to a container at one end, and at the other end is removably insertable into the hole on the horizontal surface. Preferably, the container has two prongs, which are adjustable along three dimensions, thereby enabling the container to be attached to a horizontal surface having holes of numerous configurations.

The present invention is particularly adaptable to be suspended from the top cap of a ladder. Top caps of ladders, typically are constructed with holes of various configurations. The adjustable nature of the prongs of the invention enable the container to be suspended from a variety of ladders containing a variety of configurations of holes. In addition, the adjustability of the prongs enables the bottom surface of the container to lay flat even as the ladder is positioned at various levels of inclination. In a preferred embodiment, the dimensions of the container are sufficient for holding tools, paint cans, and other items often needed by the users of ladders. The suspension of the container from the top cap of a ladder enables the user to have access to items inside the container while standing on the ladder.

Because the prongs of the device are removably insertable into a number of ladders, the device is both easy to use, efficient, and economical. The device, however, is not limited to use only with ladders, it may be used on scaffolding or other ledges that contain horizontal surfaces containing holes. In addition, the container could include a removable and/or rotatable lid for protecting items in the container.

In the preferred embodiment, the adjustable prongs are comprised of a horizontal member that is perpendicularly attached to a vertical member. The horizontal member is attached to a flange which is perpendicularly attached to the top edge of one of the sidewalls of the container. The horizontal member is adjustably attached to the flange and the vertical is adjustably attached to the horizontal member.

BRIEF DESCRIPTION OF THE DRAWINGS

The accompanying drawings, which are incorporated in and form a part of the specification, illustrate the embodiments of the present invention and, together with the description serve to explain the principles of the invention.

In the drawings.

DETAILED DESCRIPTION OF THE PREFERRED EMBODIMENTS

Figure 1:
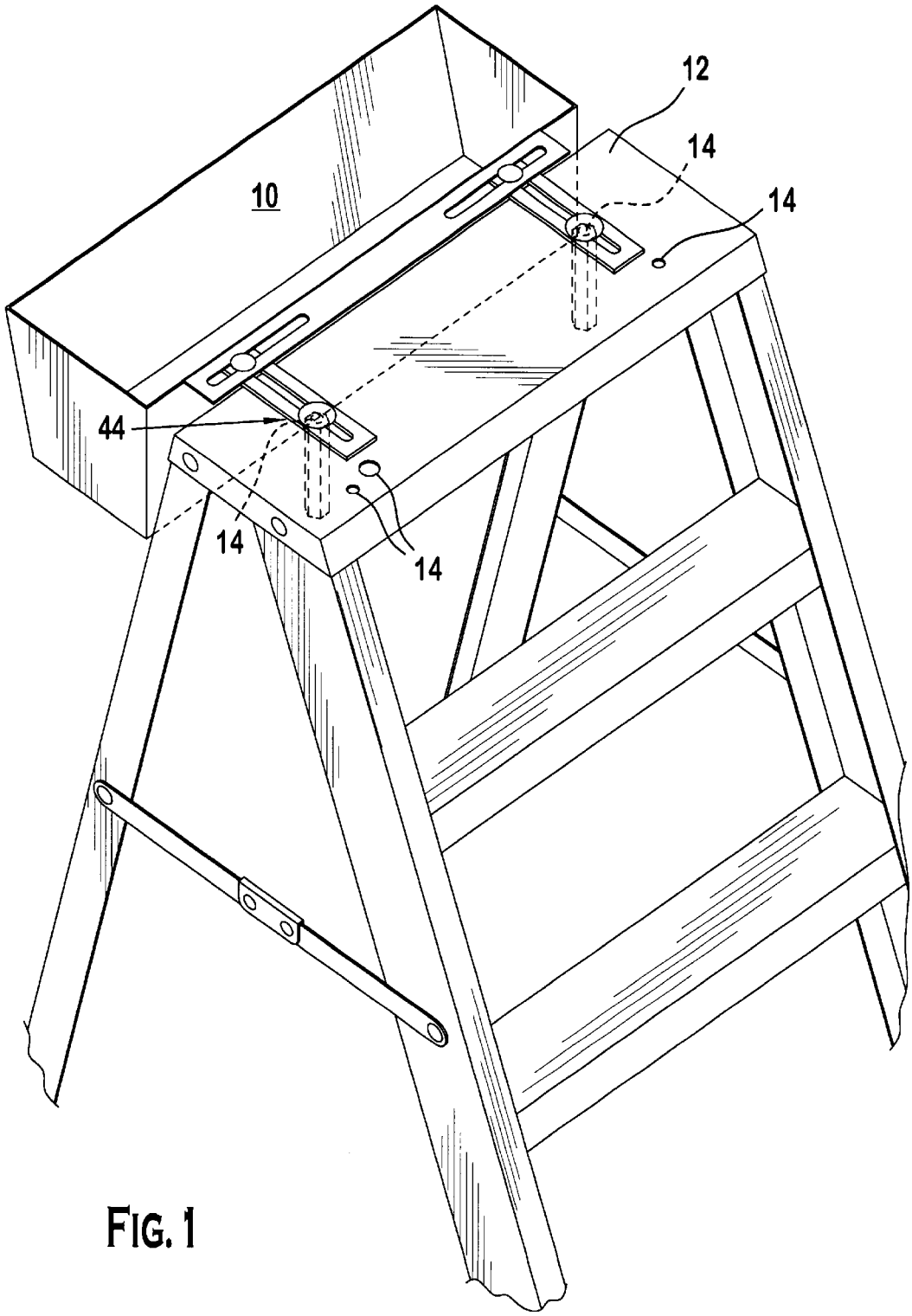
FIG. 1 is a perspective view of the device according to the invention, showing the device attached to a ladder.
Figure 2:
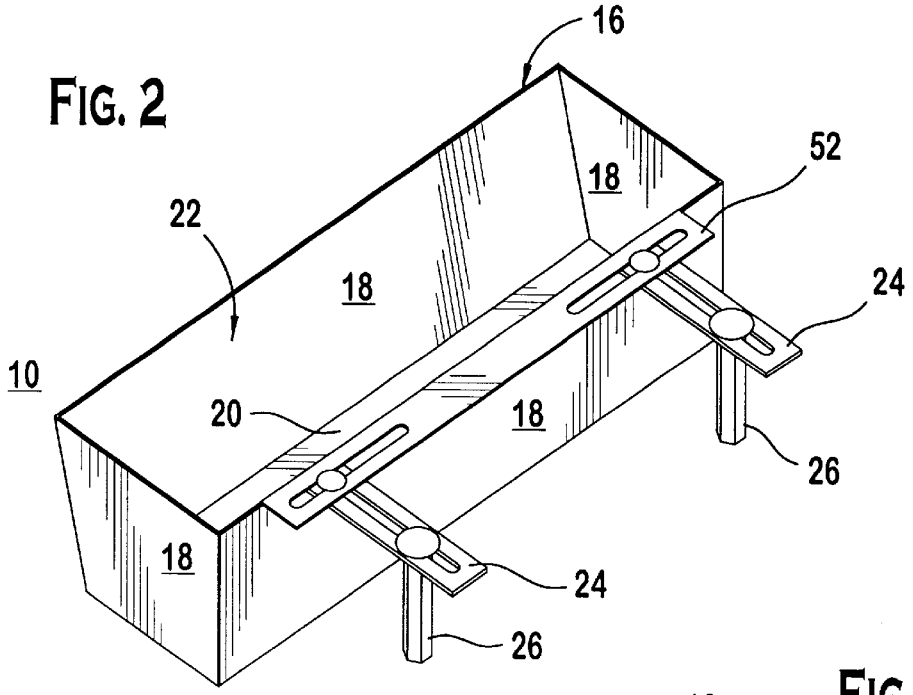
FIG. 2 is perspective view of a preferred embodiment of the device according to the invention.
Figure 3:
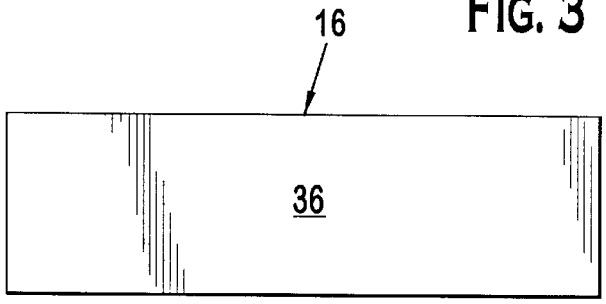
FIG. 3 is a front elevation view of the container of the device.

In describing a preferred embodiment of the invention illustrated in the drawings, specific terminology will be used for the sake of clarity. However, the invention is not intended to be limited to the specific terms so selected, and it is to be understood that each specific term includes all technical equivalence which operate in a similar manner to accomplish a similar purpose.

With reference to the drawings, in general, and FIGS. 1–14 in particular, the device of the present invention is disclosed.

FIG. 1 shows a suspendible device 10 suspended by at least one prong 44 inserted in at least one hole 14 of a horizontal surface 12. In this preferred embodiment, the device 10 is suspended by two prongs 44 inserted in two holes 14 in the horizontal surface 12, which is the top cap of a ladder. However, the device 10 may be suspended from any horizontal surface containing at least one hole.

FIG. 1, along with FIGS. 2–5, show a preferred embodiment of the device 10. As illustrated in these Figs. , the device 10 includes a container 16. The container 16 is made of a plurality of side walls 18 and a bottom wall 20 which are connected to one another thereby defining a cavity 22 into which items may be placed. In this embodiment, the prongs 44 are made of a horizontal member 24 and a vertical member 26, which is generally perpendicularity attached to the horizontal member 24. The horizontal member 24 has a container end and a suspension end. The container end is the end that is closest to the container 16 and the suspension end is the end that is furthest from the container 16. The vertical member 26 is removably insertable into the hole 14 of the horizontal surface 12.

Figure 4:
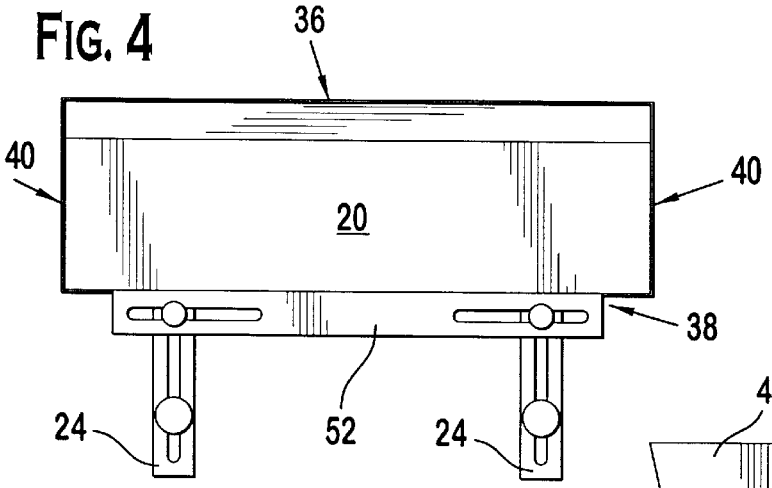
FIG. 4 is a top view of a preferred embodiment of the device.
Figure 5:
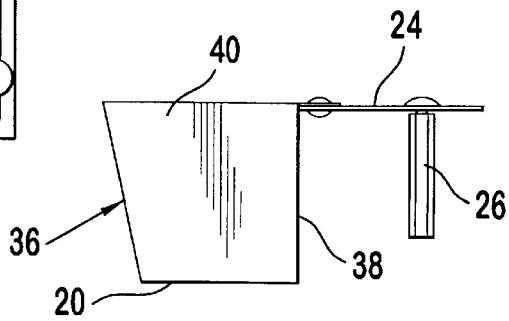
FIG. 5 is a side elevation view of a preferred embodiment of the device.

Each sidewall 18 has a top edge and a bottom edge. One a sidewall 18 has a flange 52 projecting from the top edge of the sidewall 18. In this preferred embodiment, the flange 52 is molded from the same material as the container 16 is made. In a preferred embodiment, the container 16 and flange 52 are molded from plastic, and the horizontal member 24 and vertical member 26 are made of metal. It is to be understood that the type of metal from which the horizontal member 24 and vertical member 26 are made is discretionary. However, metals that can be used include, but are not limited to, sheet metal, tin, aluminum and copper. The type of metal from which the container 16 and flange 52 can be formed also is discretionary, however a preferred metal is sheet metal. Other metals that can be used include, but are not limited to, tin, aluminum and copper. Alternatively, the container 16 and flange 52 can be molded from any of the plastics currently known in the art or later developed. FIGS. 4 and 5 show a preferred embodiment in which container 16 has a front sidewall 36, a back sidewall 38, and two end sidewalls 40. One end sidewall 40 is located between each front sidewall 36 and back sidewall 38. Preferably, the front sidewall 36 has dimensions of approximately 14.5 inches long and 4.75 inches wide; each end sidewall 40 has dimensions of about 3.25 inches high, 3.75 inches wide along the bottom edge, and 4.75 inches wide along the top edge; and the flange has dimensions of approximately one inch wide and $1/16^{th}$ of an inch thick. It is also preferred that the horizontal member 24 be about ¾ inches wide, 4 ½ inches long and $1/8^{th}$ of an inch thick.

As one skilled in the art would recognize, different dimensions for each of the above-named parts may be used depending on the particular use intended for the device. For example, a worker on scaffolding may require a container longer or shorter than 14.5 inches.

Figure 6:
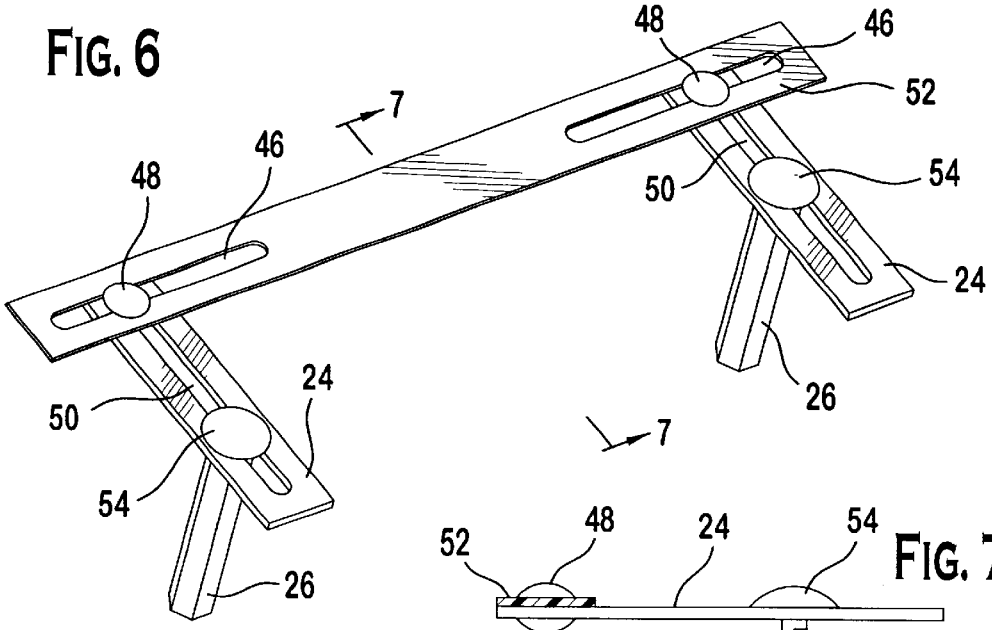
FIG. 6 is a fragmentary perspective view of the device illustrating the adjustable features of the prongs.
Figure 7:
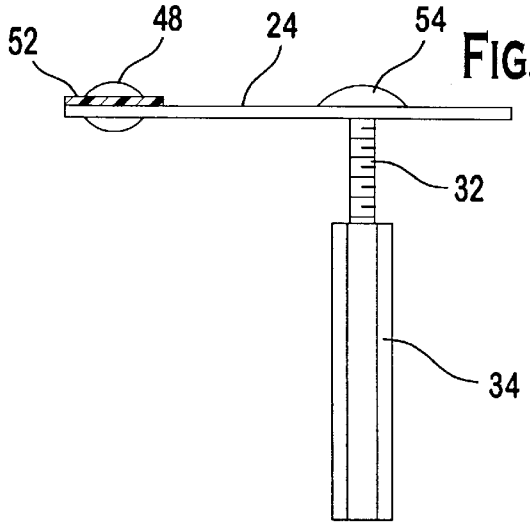
FIG. 7 is a cross-sectional view of fragmentary perspective view 6.
Figure 8:
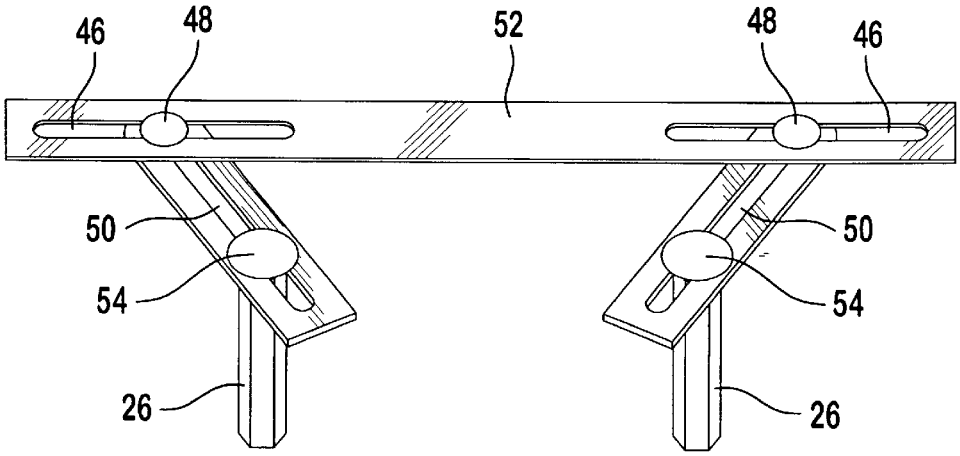
FIG. 8 is a fragmentary perspective view of the device illustrating the adjustable features of the prongs.

FIGS. 1–5, along with FIGS. 6–8, particularly illustrate the adjustable embodiments of the horizontal member 24 and the vertical member 26. As seen in these embodiments, the flange 52 has at least one elongated slot 46 to which the horizontal member 24 is attached. The horizontal member 24 may be attached anywhere along the elongated slot 46. In addition, as seen in these embodiments, the horizontal member 24 may be attached to flange 52 at a 90 degree angle, thereby creating a perpendicular orientation between the horizontal member 24 and the flange 52, as seen in FIG. 6. Alternatively, the horizontal member 24 may be attached to flange 52 at an angle that is greater than or less than 90 degrees, thereby creating a diagonal orientation between the horizontal member 24 and the flange 52, as illustrated in FIG. 8. The horizontal member 24 can be attached to the elongated slot 46 by any adjustable fastener 48 currently known in the art or later developed. Adjustable fasteners that could be used include, pins, screws, bolts, rivets and the like.

FIGS. 6–8 also particularly show the adjustable nature of the vertical member 26 in relation to the horizontal member 24. In this preferred embodiment, the vertical member 26 is shown in the form of a stove bolt 32. Each horizontal member 24 contains a channel 50 through which the stove bolt 32 may be inserted. The stove bolt 32 contains a head 54 which is wider than the channel 50. Accordingly, as the stove bolt 32 is inserted through the channel 50, the head 54 cannot pass through the channel 50. A hex-nut 34 is then threadable onto the bottom of the stove bolt 32 to rest against the underside of the horizontal member 24, thereby holding the stove bolt 32 in place along the channel 50. As illustrated in FIGS. 6–8, the stove bolt 32 can be attached to the horizontal member 24 at any point along the channel 50, thereby creating a range of adjustability for the stove bolt anywhere along the length of the horizontal member 24. As a result of the adjustability of both the horizontal member 24 and the vertical member 26, which in this preferred embodiment is a stove bolt 32, the device 10 can be suspended from any member of configurations of holes 14 in a horizontal surface 12.

As discussed above, the flange 52 and the container 16 can be one piece made of the same material. For example, the flange 52 and container 16 can be molded together or can be made from one piece of sheet metal. In another embodiment, the flange 52 and container 16 are separate pieces that are attached to each other.

Figure 9:
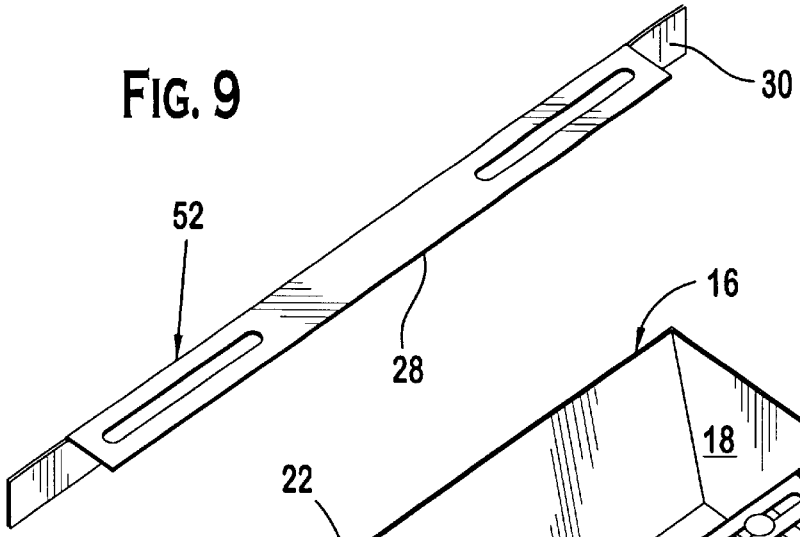
FIG. 9 is a view of a version of the flange.
Figure 10:
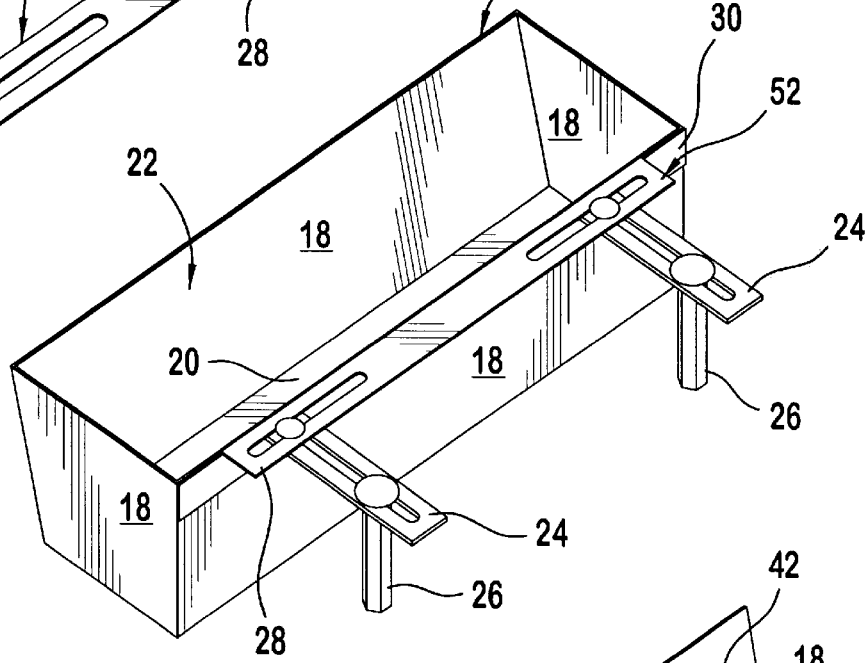
FIG. 10 is a perspective view of an embodiment of the device according to the invention.

FIG. 9 illustrates a preferred embodiment of the flange 52 where the flange 52 is comprised of a projecting arm 28 and an attachment arm 30. Device 56 is shown in FIG. 10. In this embodiment, the flange 52 is attached to the container 16. Preferably, the attachment arm 30 of the flange 52 is attached to the container 16 by welding. However, the manner by which the flange 52 is attached to the container 16 is discretionary. As a result, the flange 52 could be attached to the container 16 by an adhesive, rivets, and the like. In this embodiment, the attachment arm 30 is generally perpendicularly oriented to the projecting arm 28. Preferably, the projecting arm 28 has a length that is shorter than the attachment arm, and the projecting arm 28 is centrally located along the attachment arm 30. The horizontal member 24 is attached to the projecting arm 28, in the manners previously described in relation to FIGS. 1–8.

Figure 11:
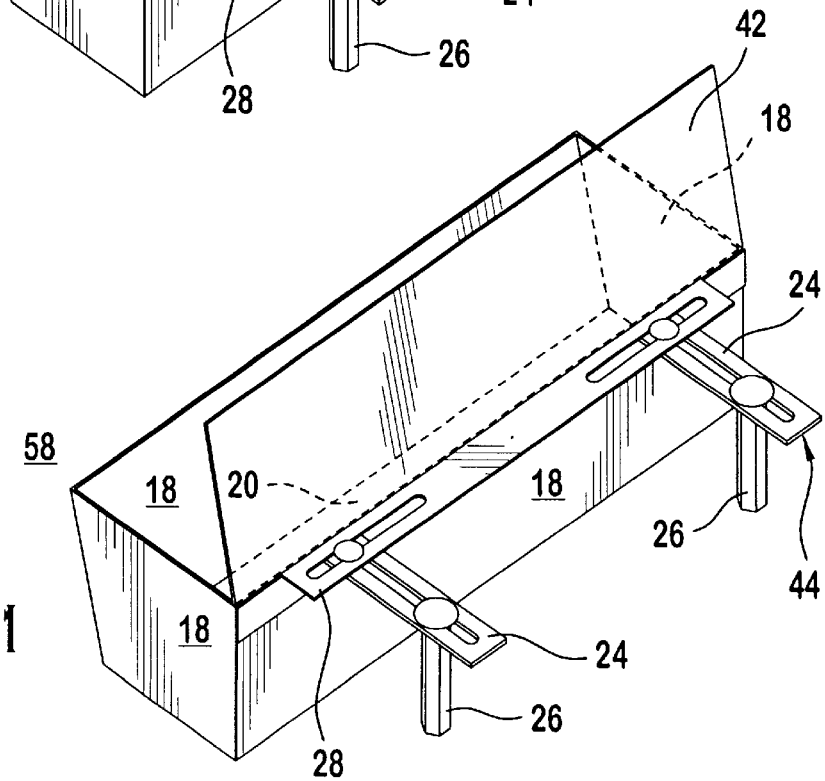
FIG. 11 is a perspective view of the device according to the invention, with a removable lid shown.

Reference is now made to FIG. 11 which is another embodiment of the device 58. In this embodiment, the horizontal member 24 is attached to the top edge of one of the sidewalls 18 directly. In this embodiment, the horizontal member may be adjustably attached to the sidewall 18 by any number of adjustable fasteners currently known in the art or later developed. Alternatively, the horizontal member 24 could be fixedly attached to sidewall 18. This embodiment also shows an optional lid 42 which may be removably attached to one of the sidewalls 18.

Figure 12:
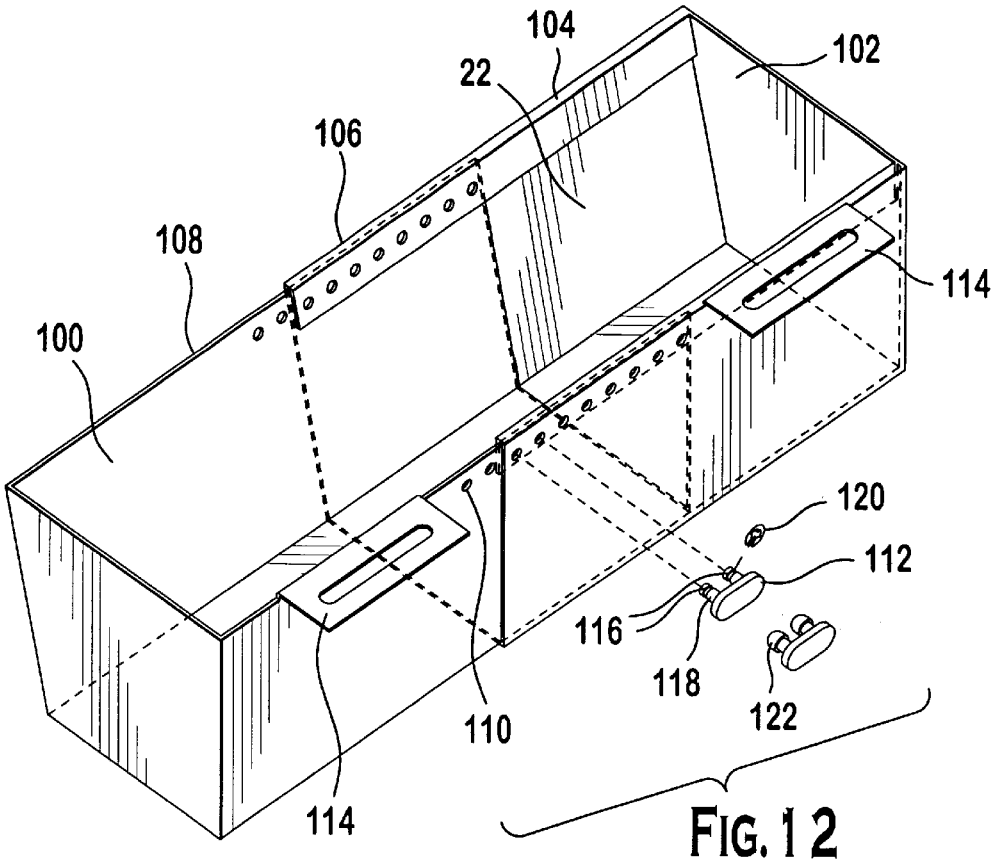
FIG. 12 is a perspective view of the device, according to one embodiment.
Figure 13:
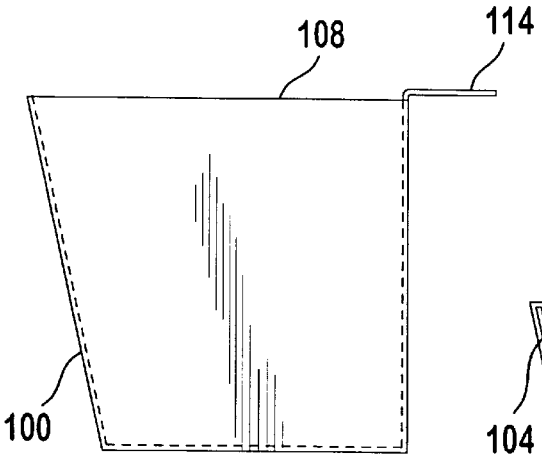
FIG. 13 is a side view of an inner piece of FIG. 12, according to one embodiment.
Figure 14:
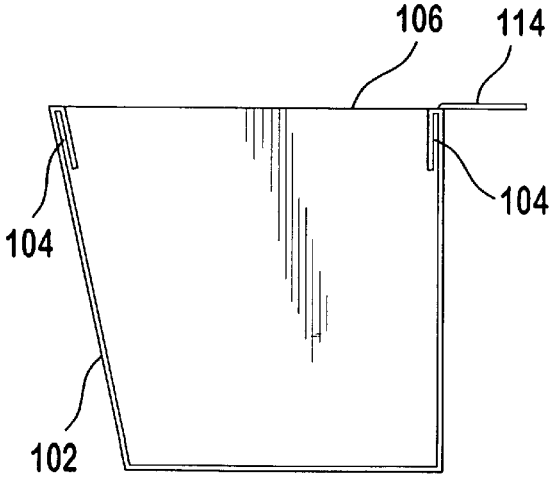
FIG. 14 is a side view of an outer piece of FIG. 12, according to one embodiment.

In an alternative embodiment, the container 16 could be made of two pieces so as to be adjustable in size. As illustrated in FIGS. 12–14, this is accomplished by allowing an inner piece 100 to fit inside an outer piece 102. A folded or formed channel 104 is located on a top edge 106 of the outer piece 102 to hold a top edge 108 of the inner piece 100 allowing them to slide together. Holes 100 are formed through the top edges of both pieces to permit the pieces to be locked together, with a clip 112, at the desired size. Instead of one flange 52 on the side of the container 16, there are two shorter brackets 114, one on the inner piece 100 and one on the outer piece 102. Each bracket 114 would be designed to allow the same adjustability as the flange 52. The clip 112 is made to insert through two of the holes 110 on the top edge. The clip 112 has a groove 116 cut in a pin part 118 to allow an "E" ring 120 to snap onto it, thus securing the pin 118 in place. The pins 118 could also be made with a knob 122 on the end causing it to snap in place. Each half of the container 16 would be similar in shape to the original design, but would be 10 ¼" long, allowing adjust from approximate 14" to 19" in length.

Although this invention has been illustrated by reference to specific embodiments, it will be apparent to those skilled in the art that various changes and modifications may be made which clearly fall within the scope of the invention. The invention is intended to be protected broadly within the spirit and scope of the appended claims.

What is claimed is:

1. A combination of a ladder and a suspendible device for holding items connected to the ladder, the ladder including a top surface with at least one hole, the suspendible device comprising:

a container comprising a plurality of sidewalls and a bottom wall, the sidewalls and bottom wall connected to one another to define a cavity;

a projecting arm with at least two slots connected to the container;

at least two approximately horizontal members each having an open channel defined therein, the at least two approximately horizontal members each being connected to the projecting arm by respective first fasteners extending through the respective channels in the respective horizontal members and the respective slots in the projecting arm; and a generally vertical member being connected to each of the at least two approximately horizontal members by respective second fasteners extending through the respective open channels, the generally vertical members extending through the at least one hole in the top surface of the ladder to removably secure the suspendible device to the ladder.

2. The suspendible device of claim 1, wherein the suspendible device is made of metal.

3. The suspendible device of claim 1, wherein the projecting arm is made of metal.

4. The suspendible device of claim 1, wherein the projecting arm is connected to the container by a welded connection.

5. The suspendible device of claim 1, wherein the at least two approximately horizontal members and the at least two approximately vertical members are made of metal.

6. The suspendible device of claim 1, wherein the container is made of plastic.

7. The suspendible device of claim 1, wherein the container is made of metal.

8. The suspendible device of claim 1, wherein the container further comprises a removable lid.

9. The suspendible device of claim 1, wherein the respective first fasteners comprise a nut and bolt.

10. The suspendible device of claim 1, wherein the plurality of sidewalls comprises a front sidewall, a back sidewall, and two end sidewalls, each of the two end sidewalls being located between the front sidewall and the back sidewall, the side walls comprising a top edge and a bottom edge, the front sidewall having dimensions of 14.5 inches long and 4.75 inches wide, each end sidewall having dimensions of 3.25 inches high, 3.75 inches wide along the bottom edge and 4.75 inches wide along the top edge, and the projecting arm having dimensions of 1 inch wide and 1/16th inch thick.

11. The suspendible device of claims wherein the approximately horizontal member has dimensions of 3/4 of an inch wide, 4 inches long and 1/8th inch thick.

* * * * *